US011560281B2

(12) United States Patent
von Seggern et al.

(10) Patent No.: US 11,560,281 B2
(45) Date of Patent: Jan. 24, 2023

(54) DEVICE FOR RECEIVING AND HOLDING A SURFACE ELEMENT ROLL, IN PARTICULAR A DEEP-DRAWING FILM ROLL AND PACKAGING MACHINE FOR PACKING PACKAGING GOODS IN SURFACE ELEMENT PACKAGES

(71) Applicant: Jörg von Seggern Maschinenbau GmbH, Oldenberg (DE)

(72) Inventors: Jörg von Seggern, Oldenburg (DE); Klaus Von Seggern, Oldenburg (DE)

(73) Assignee: JÖRG VON SEGGERN MASCHINENBAU GMBH, Oldenberg (DE)

( * ) Notice: Subject to any disclaimer, the term of this patent is extended or adjusted under 35 U.S.C. 154(b) by 182 days.

(21) Appl. No.: 17/029,660

(22) Filed: Sep. 23, 2020

(65) Prior Publication Data

US 2021/0087008 A1 Mar. 25, 2021

(30) Foreign Application Priority Data

Sep. 23, 2019 (EP) ..... EP19 199 034

(51) Int. Cl.
*B65H 19/12* (2006.01)
*B65H 16/04* (2006.01)

(52) U.S. Cl.
CPC ..... *B65H 19/123* (2013.01); *B65H 16/04* (2013.01); *B65H 2301/3251* (2013.01); *B65H 2301/364* (2013.01); *B65H 2301/413226* (2013.01); *B65H 2801/81* (2013.01)

(58) Field of Classification Search
CPC ..... B65H 19/123; B65H 16/04; B65H 2301/3251; B65H 2301/364; B65H 2301/413226; B65H 2801/81
See application file for complete search history.

(56) References Cited

U.S. PATENT DOCUMENTS 554,934 A 2/1896 Johnson
3,291,415 A 12/1966 Bursk
3,690,583 A * 9/1972 Herman ..... B21C 47/24 242/559.3

(Continued)

FOREIGN PATENT DOCUMENTS

EP 0943568 A1 9/1999
EP 1256538 A2 11/2002

(Continued)

OTHER PUBLICATIONS

European Search Report in application No. EP 1919304 dated Mar. 3, 2020; pp. 1-3.

*Primary Examiner* — William A. Rivera
(74) *Attorney, Agent, or Firm* — Muncy, Geissler, Olds & Lowe, P.C.

(57) ABSTRACT

A packaging machine for packaging goods in film packages, equipped with a device for receiving and holding a surface element roll, so as to process it in a packaging machine by unrolling the surface element and introducing the surface element into the packaging machine, comprising an axle to be incorporated into the surface element roll on its rotational axis of symmetry, wherein the axle is received in a swivel receiver, and the axle for unrolling the surface element is held with the swivel receiver in a roughly vertical alignment.

10 Claims, 5 Drawing Sheets

(56) References Cited

U.S. PATENT DOCUMENTS

| | | | | |
|---|---|---|---|---|
| 4,863,112 | A * | 9/1989 | Summerauer ..... | B21D 43/20<br>414/618 |
| 4,971,264 | A * | 11/1990 | Lepach ..... | B65H 67/04<br>242/473.6 |
| 2004/0079831 | A1 | 4/2004 | McNeil et al. | |
| 2011/0233318 | A1 | 9/2011 | Anderson | |
| 2016/0257524 | A1 | 9/2016 | Gardner et al. | |

FOREIGN PATENT DOCUMENTS

| | | | |
|---|---|---|---|
| EP | 2982628 | A1 | 2/2016 |
| GB | 2405137 | A | 2/2005 |

* cited by examiner

DEVICE FOR RECEIVING AND HOLDING A SURFACE ELEMENT ROLL, IN PARTICULAR A DEEP-DRAWING FILM ROLL AND PACKAGING MACHINE FOR PACKING PACKAGING GOODS IN SURFACE ELEMENT PACKAGES

FIELD OF DISCLOSURE

The invention relates to a device for receiving and holding a surface element roll, in particular a deep-drawing film roll, so as to process it in a packaging machine by unrolling the surface element and introducing the surface element into the packaging machine, comprising an axle to be incorporated into the surface element roll on its rotational axis of symmetry. The invention further relates to a packaging machine for packing packaging goods in surface element packages.

BACKGROUND

Foodstuffs or also inorganic products are routinely offered to consumers in small packages. These small packages are often designed as surface elements, wherein a base film can be present, on which the foodstuffs or other packaging goods are placed. An additional surface element is subsequently placed on the base film, for example a film is sealed on, so as to in this respect generate a liquid- and gas-tight package. The surface elements used can be films or paper webs, for example.

The surface elements used for the packages are processed in packaging machines. To this end, the surface elements are supplied in the form of surface element rolls. Precisely a surface element roll, for example for a base film, can here have a larger thickness, and a correspondingly rolled-up surface element has a corresponding volume. Such surface element rolls are already referred to as jumbo rolls.

As a rule, a base film for packages produced with a packaging machine is a deep-drawing film. This film is deep-drawn in the packaging machine, so that individual depressions form for receiving foodstuffs or other objects. This film is thus to be introduced into the packaging machine at the start of processing. Packaging machines routinely have an elongated structural design, which actually can have an extension of 10 or more meters. In several packaging machines, supplying a deep-drawing film and supplying the packaging goods to be filled into the packages here takes place via one and the same inlet side of a packaging machine. This impedes the supply of the deep-drawing film, with the introduction of the new surface element roll being difficult in particular. This introduction of the new surface element roll is in part still handled manually in prior art, in that an empty surface element roll is removed from the packaging machine and a new surface element roll is provided. Incorporating the axle like this is difficult due to the high weight of the axle.

It is then often the case that a film is unrolled and the film is introduced into the packaging machine with the film horizontally aligned. The film is exposed to contaminants in the room air, and if the packaging good is then also supplied above the film, the surface element could potentially become soiled by the product. In addition, the film can become soiled due to cleaning processes and the cleaning agents used in the latter. This leads to contamination in packages to be produced, which can also hamper the sealing of another film onto the deep-drawing film, for example. Leaky packages can be the result.

Therefore, it has already been proposed that the surface element roll, in particular the deep-drawing roll, be removed from the alignment of the packaging machine and arranged next to the packaging machine. In these known devices, the surface element roll is horizontally aligned and arranged next to the packaging machine, after which the surface element is again introduced into the packaging machine in a horizontal extension with several deflections.

While the surface element, in particular the deep-drawing film, was here removed from the introduction area of the objects to be packaged, the horizontal arrangement of the surface element here again requires that the surface element be guided in a horizontal extension. Contamination by room air remains a disadvantage. Moreover, the horizontal extension of the surface element in its width causes it to be introduced into the packaging machine from outside, and the packaging machine must in this respect be lengthened by the width of the surface element. As a result, more space is thus required.

SUMMARY

The object of the invention is to indicate a device of the type mentioned at the outset, with which a more compact structural design of the packaging machine is enabled, and with which a surface element can be introduced into the packaging machine with less contamination. In addition, a new packaging machine is also to be indicated.

With respect to the device for receiving and holding a surface element roll, this object is achieved according to the invention by virtue of the fact that the axle for the surface element roll is received in a swivel receiver, and held with the swivel receiver in roughly a vertical alignment for unrolling the surface element.

The device according to the invention also has an axle for receiving the surface element roll. It is incorporated into the rotational axis of symmetry of the surface element roll to be supplied, so that the surface element roll can be unrolled with the help of the axle. In the device according to the invention, the axle is incorporated while the axle is received in a swivel receiver. The axle can thus not be freely and manually manipulated; it is received in the swivel receiver, and the surface element roll must in this respect be moved up to the axle. Once the surface element roll has been placed on the axle, this axle can be held in a vertical alignment according to the invention with the surface element. The surface element is unrolled from the surface element roll in a vertical alignment, and this vertical alignment of the surface element yields a decreasing contamination, and causes only a small supporting surface to become soiled. The surface element can subsequently be deflected, for which purpose the device can have deflection units with rolls running at a 45° angle. The surface element is supplied in a compact manner, since it never has to be transferred to a horizontal alignment while being supplied.

The device according to the invention can be allocated to a packaging machine, and thus enables a compact supply of a surface element, in particular a deep-drawing film, into a packaging machine.

A further development of the invention provides that the axle with the swivel device can be transferred to a roughly horizontal alignment of the axle. The swivel receiver thus allows the axle for the surface element roll to swivel from the vertical alignment of the axle into a horizontal alignment of the axle and vice versa. A suitable swivel drive is allocated to the swivel receiver for this purpose. In the horizontal alignment of the axle, in particular the surface element rolls can be changed out more easily. The surface element roll can be received by the axle in a horizontal direction, and a new surface element roll can be placed upon the axle with the latter in a horizontal alignment.

A further development of the invention provides that the swivel receiver holds a slip-on mandrel, which comprises the axle to be incorporated into the surface element roll. In this further development, the axle for the surface element roll is comprised of a slip-on mandrel, onto which the surface element roll can be slipped. If the slip-on mandrel is then swiveled with the swivel receiver in a vertical alignment of the slip-on mandrel, the surface element roll with a vertical axis rests upon the swivel receiver, loading the slip-on mandrel and swivel receiver with its mass. This yields a secure arrangement of the surface element roll.

The slip-on mandrel preferably has allocated to it a rotary drive, which supports the unrolling of the surface element from the surface element roll.

A next further development of the invention provides that the swivel receiver be height adjustably received in a carrying structure. The swivel receiver can thus be adjusted in terms of its height, for example so that it can be brought into a lowered state for receiving a new surface element roll. In this state, a new surface element roll is moved toward the swivel receiver, for example with a forklift or with a lift truck, and slipped onto the then horizontally aligned slip-on mandrel. The swivel receiver can subsequently be swiveled, and the received surface element roll is also swiveled. The height adjustability of the swivel receiver then makes it possible to optimally adjust the height of the surface element roll, so that the surface element to be unrolled is correctly positioned when supplied. Changes in height can ensure that the surface element is correctly positioned when introduced, even over the entire film being supplied. If the surface element discernibly runs out of the designated path, a correction can be made by lowering or lifting the arrangement of the surface element roll in the swivel receiver.

It is constructively provided that the swivel receiver have a floor plate, into which the slip-on mandrel is recessed, and which is hinged into rotatable joints by straps arranged on their mutually opposing ends. For example, the rotatable joints can be used to introduce the required swivel forces into the swivel receiver.

The swivel receiver can here also have allocated to it fixing points for defined swivel positions of the swivel receiver, for example for vertically positioning the slip-on mandrel for unrolling the surface element or horizontally aligning the slip-on mandrel for changing out the surface element roll to be processed.

The device according to the invention can be retrofitted for existing packaging machines. On the other hand, a packaging machine can be equipped with this type of device right away. With respect to such a packaging machine of the type mentioned at the outset, for which an independent protection is being claimed, it can thus be provided that it be equipped with at least one device for receiving and holding a surface element roll of the kind described above. This equipping process advantageously enables an integration of the device for receiving and holding the surface element roll in the packaging machine. This yields additional space savings. The swivel receiver of the surface element roll can use suitable driving means of the packaging machine, in particular electric, hydraulic or pneumatic driving means.

Such a packaging machine then preferably provides that the device described above for receiving and holding the surface element roll be laterally arranged in relation to the longitudinal extension of the packaging machine. Finally, it can also be provided that the packaging machine be a deep-drawing packaging machine, and that a deep-drawable surface element be provided with the device described above.

BRIEF DESCRIPTION OF THE DRAWINGS

Exemplary embodiments of the packaging machine according to the invention as well as the device according to the invention for receiving and holding a surface element roll are shown in the drawings. Shown on.

DETAILED DESCRIPTION

Figure 1:
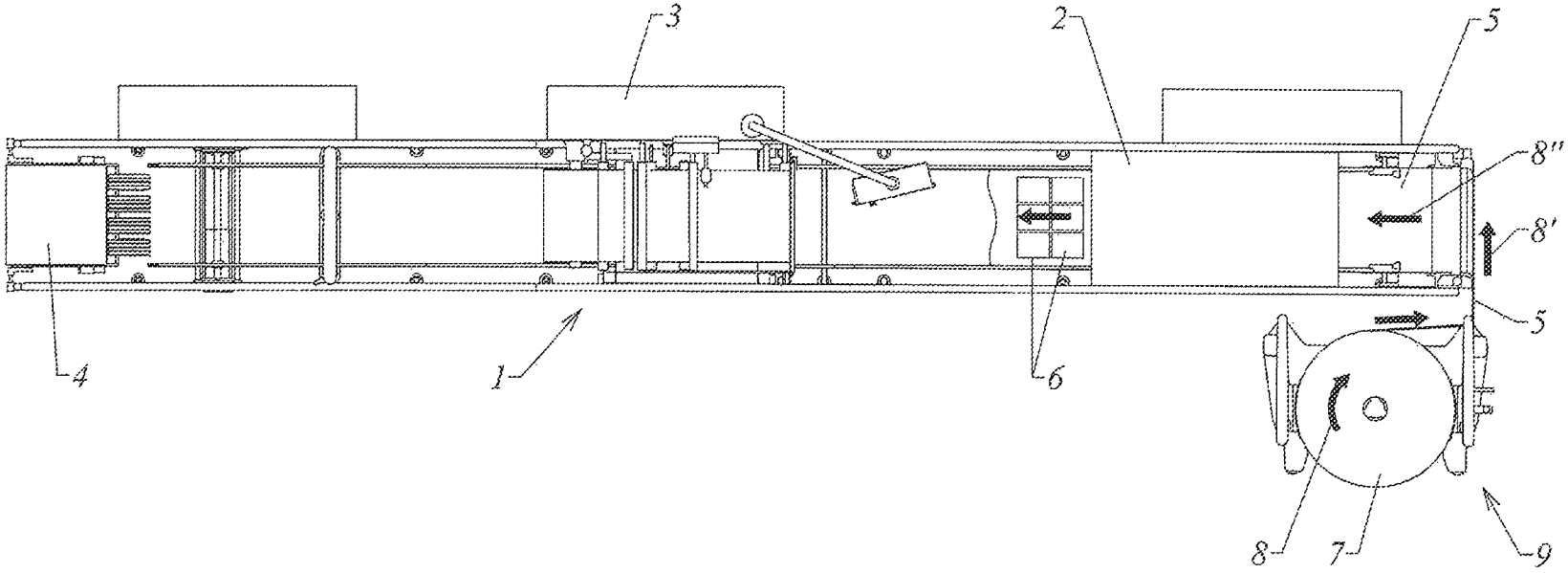
FIG. 1 is a schematic top view of a packaging machine according to the invention.

The packaging machine 1 shown on FIG. 1 is elongated, and has different processing stations. A deep-drawing station 2 is provided for deep drawing, as is a supply device arranged at about the same location for objects to be packaged. In addition, there is a welding station 3 for a lid film, as well as a separating station 4 for separating the individual packages from each other. The basis for the packages to be produced is a surface element 5, a deep-drawable film 5. Depressions 6 are incorporated into the latter by deep drawing. The depressions 6 form receiving spaces for foodstuffs, inorganic products, or other packaging items.

The surface element 5 is removed from a surface element roll 7, wherein the surface element 5 is here unrolled from the surface element roll 7, as denoted by the arrow 8. Deflection units 21 are then used to supply the surface element 5 into the packaging machine 1 along the arrows 8' and 8". The device 9 for receiving and holding the surface element roll 7 is depicted in the following figures.

Figure 2:
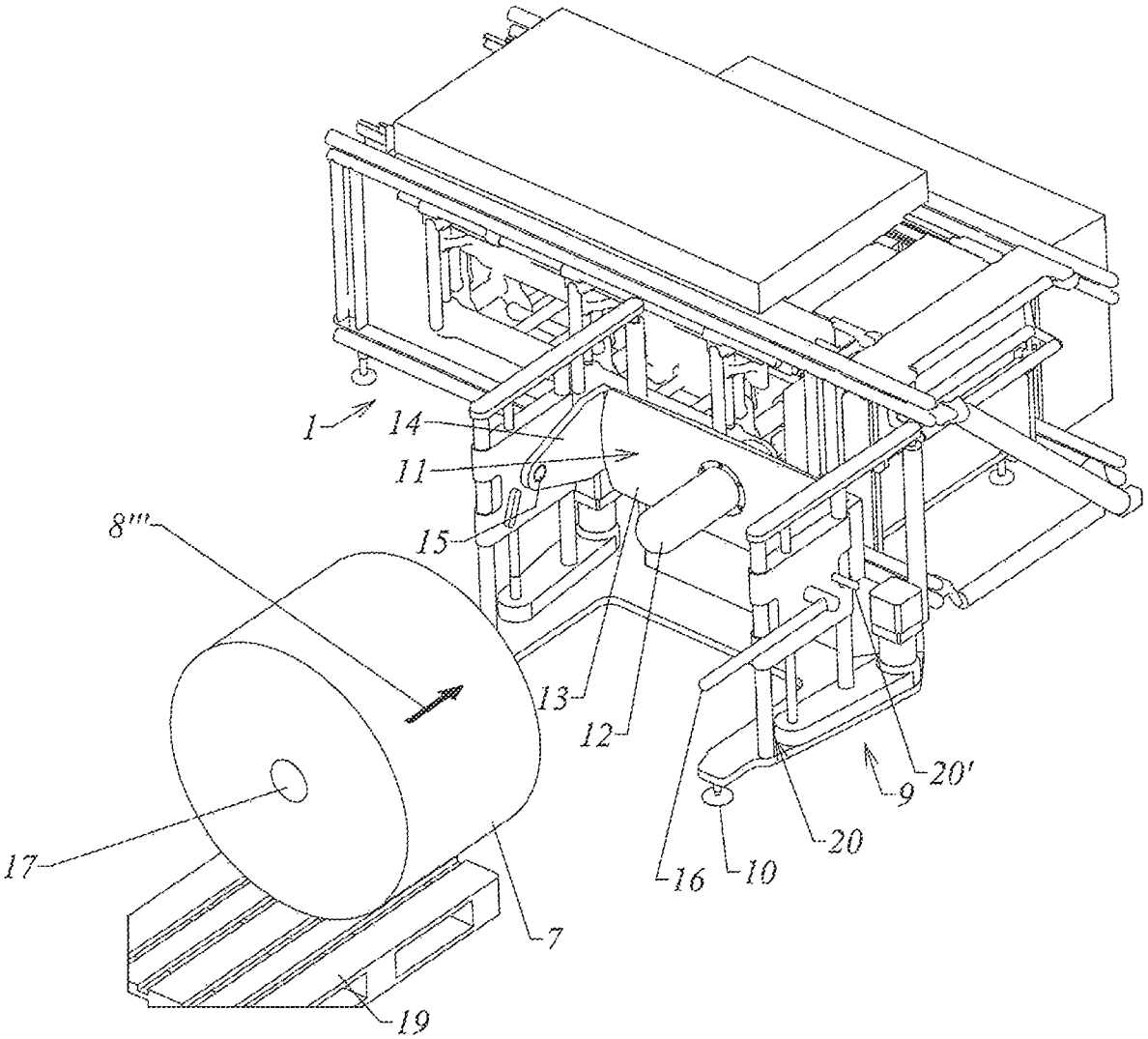
FIGS. 2 to 5 are perspective views of a device according to the invention for receiving and holding a surface element roll in different handling situations of the surface element roll.

FIG. 2 shows that the device has a carrying structure 20, which abuts against the packaging machine 1, and stands on feet 10 on the floor. A swivel receiver 11 is arranged in the carrying structure 20. This swivel receiver 11 carries a slip-on mandrel 12. The swivel receiver 11 further has a floor plate 13, which is swivelably received in rotatable joints 15 via two straps 14. The right rotatable joint on the figure has allocated to it a hand lever 16 for swiveling the swivel receiver 11.

The surface element roll 7 is also arranged on a pallet 19. It is moved in the direction of the device 9 along arrow 8'", and slipped onto the slip-on mandrel with its cavity 17.

Figure 3:
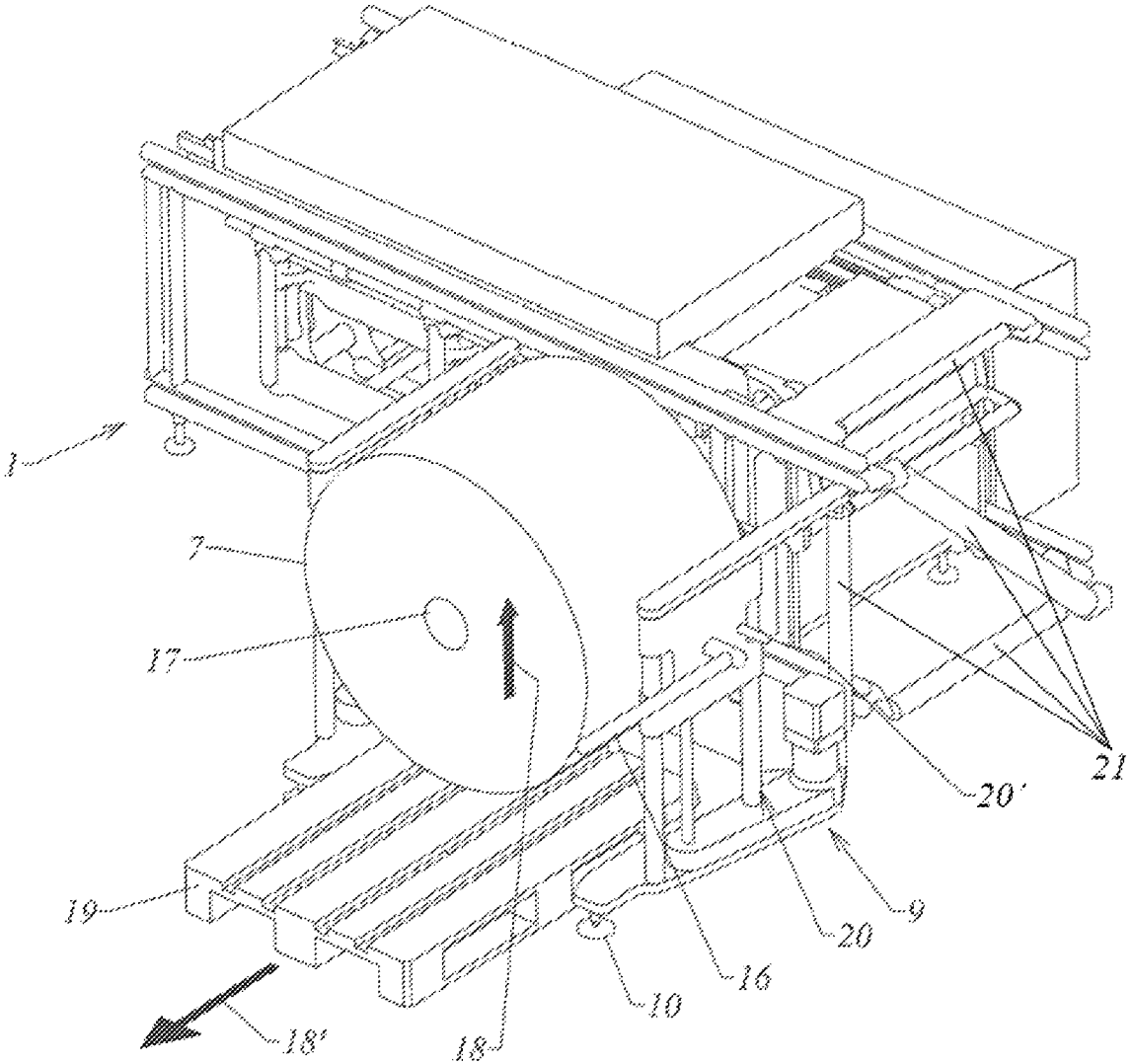

This slipped on state is shown on FIG. 3. The swivel receiver 11 is height-adjustably received in the carrying structure 20, so that once the surface element roll 7 has been slipped on, the swivel receiver 11 is guided upwardly, as denoted by arrow 18. The pallet 19 can now be removed, arrow 18'.

Figure 4:
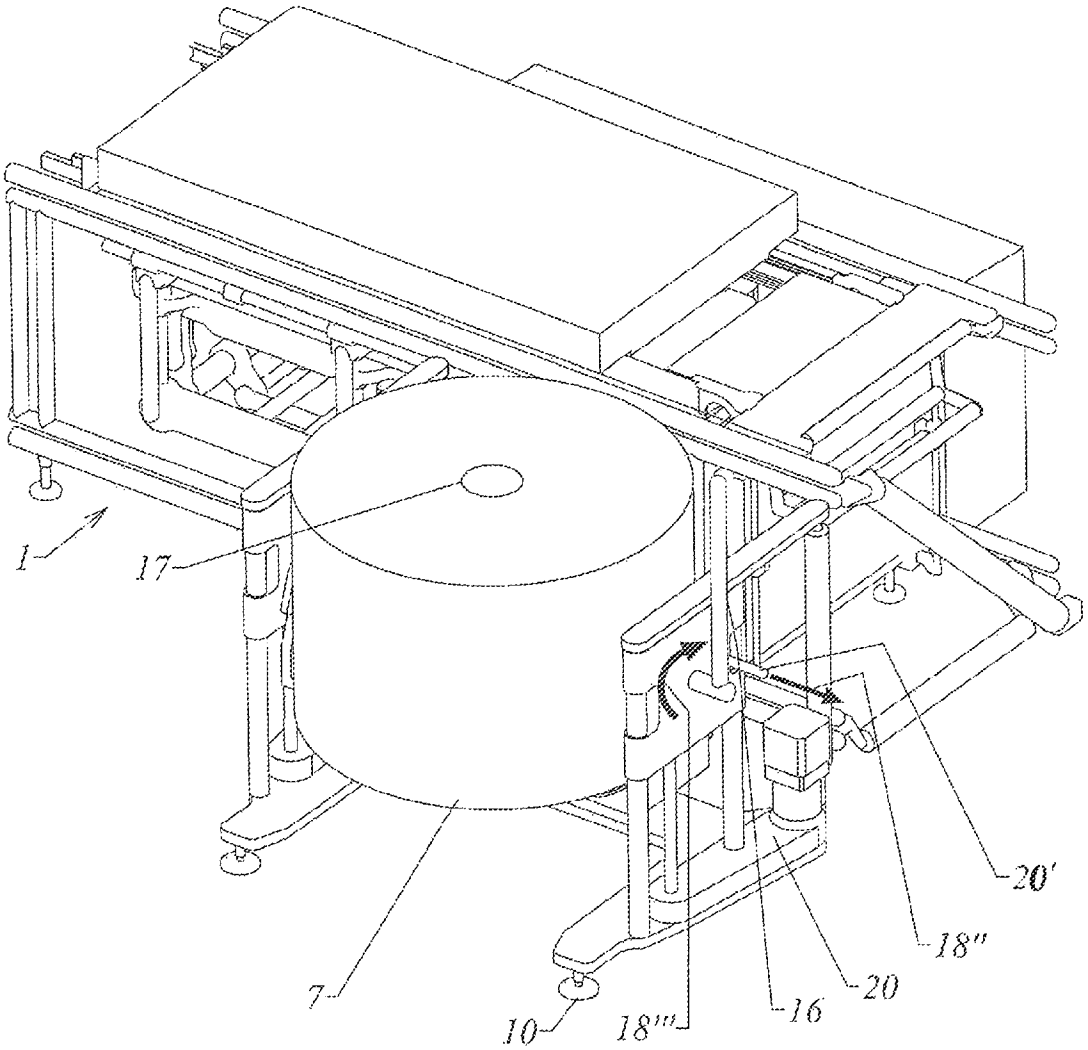

The position of the surface element roll 7 has changed on FIG. 4. Its axis has been moved out of the horizontal position into a vertical alignment, to which end the swiveling device 11 was swiveled with the hand lever 16 after a locking pin 20' had been pulled outwardly, arrow 18". The swiveling motion is illustrated by the curved arrow 18'".

Figure 5:
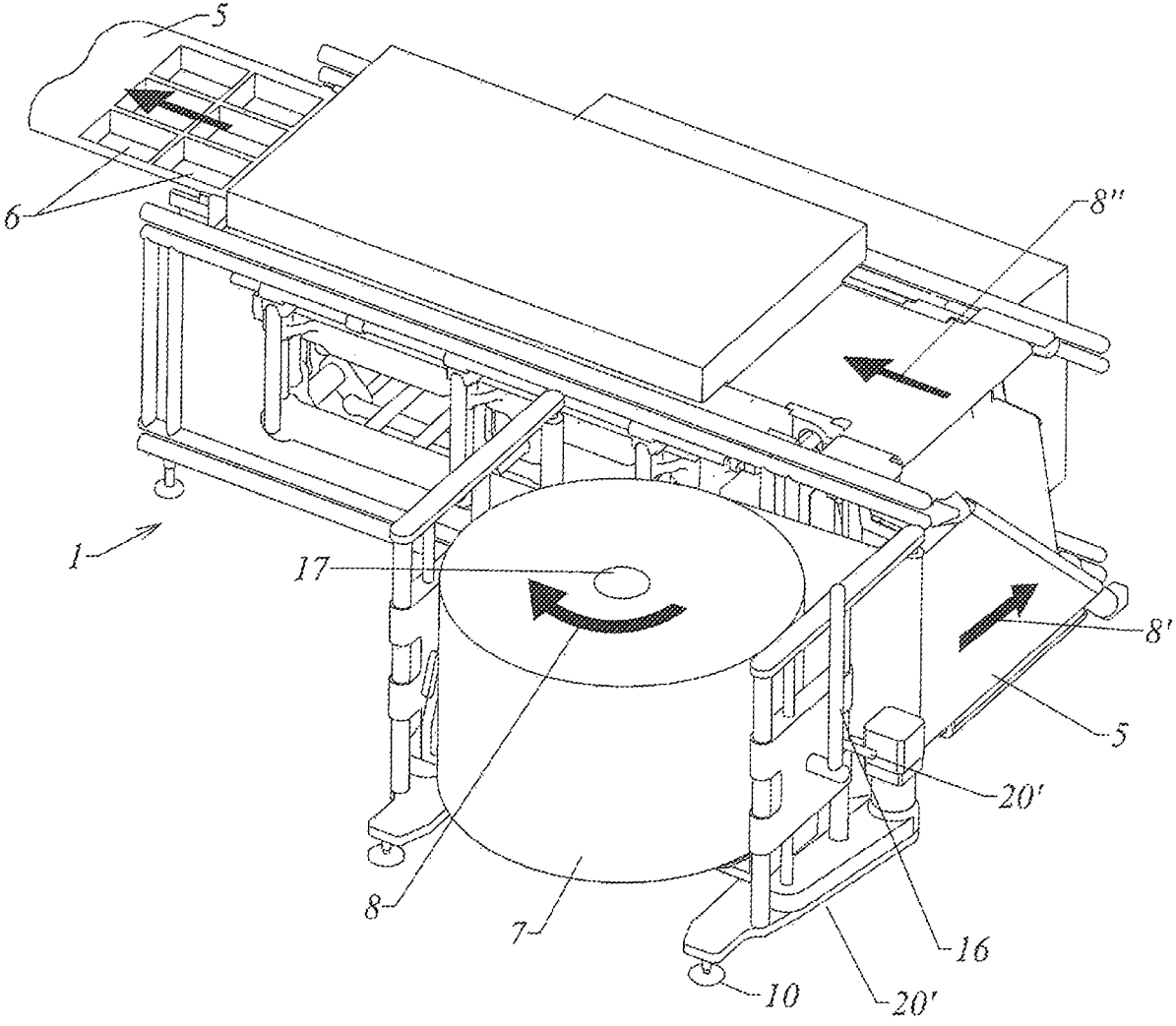

Finally, FIG. 5 again shows the situation in which the surface element 5 is unrolled from the surface element roll 7, as depicted on FIG. 1. The slip-on mandrel 12 (not visible on FIG. 5) can have allocated to it a rotary drive to support the rotation of the surface element roll 7 along arrow 8, in particular in the case of thin surface elements 5. FIG. 5 once again shows the depressions 6 in the deep-drawable surface element 5 incorporated into the deep-drawing device 2.

The invention claimed is:

1. A device for receiving and holding a surface element roll, so as to process the surface element roll in a packaging machine by unrolling the surface element roll and introducing a surface element into the packaging machine, comprising an axle incorporated into the surface element roll on a rotational axis of symmetry, wherein the axle is incorporated in a swivel receiver, and the axle for unrolling the surface element is held with the swivel receiver in roughly a vertical alignment, and wherein the swivel receiver is height-adjustably received in a carrying structure.

2. The device according to claim 1, further comprising deflection units for introducing the surface element into the packaging machine.

3. The device according to claim 1, wherein the axle with the swivel receiver can be transferred into a roughly horizontal alignment of the axle.

4. The device according to claim 1, wherein the swivel receiver is provided with a slip-on mandrel that forms the axle incorporated into the surface element roll.

5. The device according to claim 4, wherein a rotary drive is provided to the slip-on mandrel.

6. The device according to claim 4, wherein the surface element is unrolled when the slip-on mandrel is in a vertical position, the surface element roll is changed when the slip-on mandrel is in a horizontal position.

7. A packaging machine for packaging goods in film packages, wherein the packaging machine is equipped with at least one device according to claim 1.

8. The packaging machine according to claim 7, wherein the device is laterally arranged in relation to a longitudinal extension.

9. The packaging machine according to claim 7, wherein the packaging machine is a deep-drawing packaging machine, and a deep-drawable surface element is provided with the device.

10. A device for receiving and holding a surface element roll, so as to process the surface element roll in a packaging machine by unrolling the surface element roll and introducing a surface element into the packaging machine, comprising an axle incorporated into the surface element roll on a rotational axis of symmetry, wherein the axle is incorporated in a swivel receiver, and the axle for unrolling the surface element is held with the swivel receiver in roughly a vertical alignment, wherein the swivel receiver is provided with a slip-on mandrel that forms the axle incorporated into the surface element roll, wherein the swivel receiver has a floor plate, into which the slip-on mandrel is recessed, and which is hinged into rotatable joints by straps arranged on their mutually opposing ends.

* * * * *